US006067729A

United States Patent [19]

Willis

[11] Patent Number: 6,067,729

[45] Date of Patent: May 30, 2000

[54] ELASTIC SHOE BAR AND METHOD FOR DRYING SHOES

[76] Inventor: Bill D. Willis, 920 Fair View Dr., New London, Wis. 54961

[21] Appl. No.: 09/277,234

[22] Filed: Mar. 26, 1999

[51] Int. Cl.[7] ..... F26B 25/00

[52] U.S. Cl. ..... 34/499; 34/600; 34/104; 248/205.1

[58] Field of Search ..... 34/60, 61, 69, 34/90, 104, 106, 184, 499, 599, 600, 239; 248/205.1, 206.1, 309.1

[56] References Cited

U.S. PATENT DOCUMENTS

| | | | |
|---|---|---|---|
| 4,677,760 | 7/1987 | St. Louis | 34/90 |
| 5,024,408 | 6/1991 | Magee | 248/206.5 |
| 5,333,393 | 8/1994 | Hill et al. | 34/440 |
| 5,398,428 | 3/1995 | Wallace | 34/600 |
| 5,623,769 | 4/1997 | Hayden | 34/61 |
| 5,974,693 | 11/1999 | Richards et al. | 34/600 |

*Primary Examiner*—Pamela A. Wilson
*Attorney, Agent, or Firm*—Donald Cayen

[57] ABSTRACT

A shoe bar is useful for drying shoes in a conventional clothes dryer. The shoe bar has a relaxed length that is equal to or slightly greater than the inner diameter of the drum of the clothes dryer. The bar ends are inserted into the shoes. The bar is manually bent and placed in the drum. One shoe is placed against the drum inner diameter, and the other shoe is placed proximate the drum diametrically opposite the first shoe. The bar is released. The elastic material exerts a restoring force that tends to return the bar toward its relaxed configuration. The bar is too long to relax completely, so it remains at a working configuration whereat it urges the shoes against the drum. The shoes remain pressed against the drum, so they do not tumble when the clothes dryer is operated to rotate the drum.

25 Claims, 4 Drawing Sheets

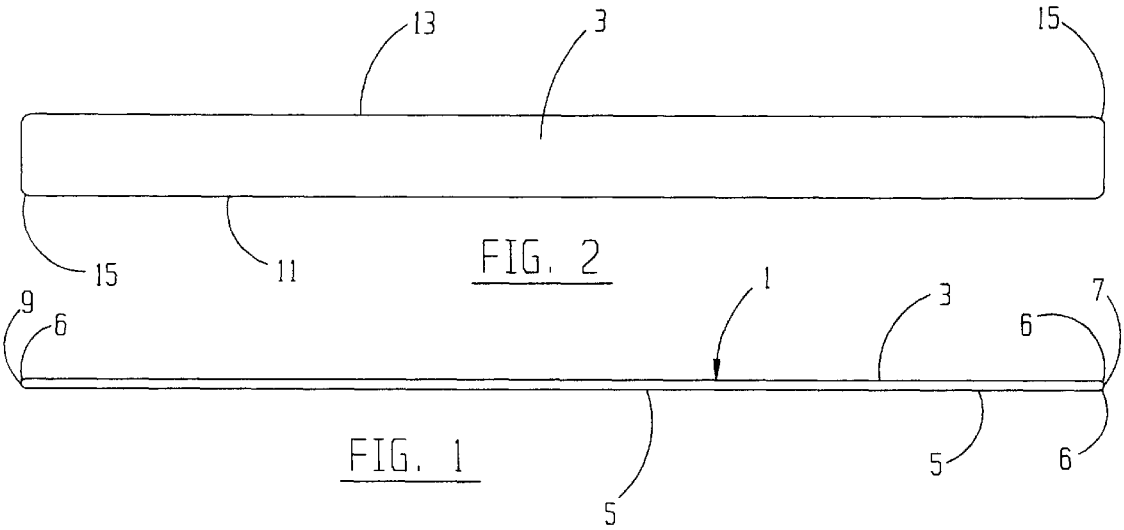
FIG. 2
FIG. 1
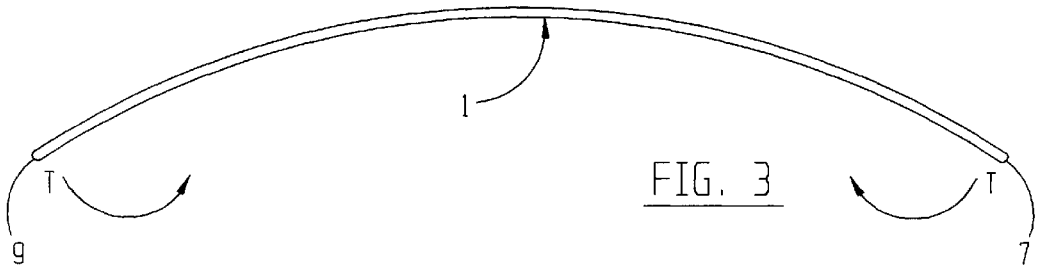
FIG. 3
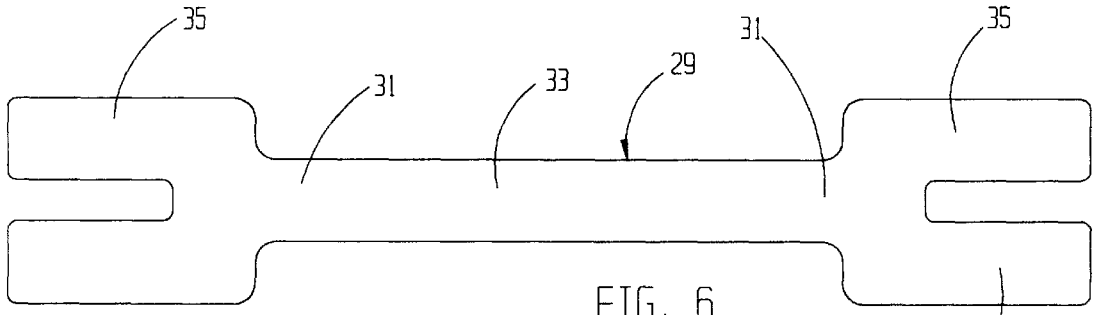
FIG. 6
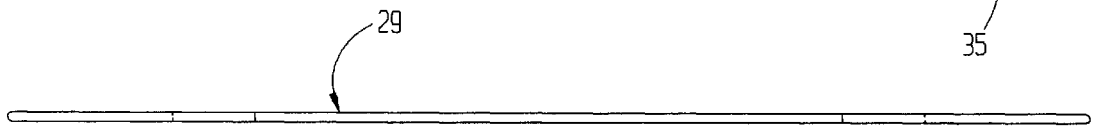
FIG. 5

ELASTIC SHOE BAR AND METHOD FOR DRYING SHOES

BACKGROUND OF THE INVENTION

1. Field of the Invention

This invention pertains to footwear, and more particularly to apparatus for drying wet shoes.

2. Description of the Prior Art

Athletic shoes have become increasingly popular during recent years. Persons of both genders and all ages wear athletic shoes for many occasions in addition to those relating to athletics. As a result, it is almost inevitable that the shoes become dirty. That problem is easily solved by washing the shoes, usually in an automatic washing machine. Subsequently, the shoes are dried, as in a clothes dryer. Alternately, the wet shoes can be placed in the sun or other warm place for drying. The washing and drying process is almost universally practiced and accepted.

It is well known that the price of athletic shoes has risen considerably in recent years. Many types of athletic shoes cost more than some high quality leather dress shoes.

Consequently, there is an incentive to care for the shoes so as to extend their useful lives.

However, the prior washing and drying practice for cleaning athletic shoes is diametrically opposed to prudent care of them. The drying process is particularly detrimental to the shoes. Placing wet shoes in the sun or other warm place invariably causes them to wrinkle as they dry.

But placing wet shoes in a clothes dryer is far worse. As the dryer operates, the shoes tumble continuously.

That action causes scuffing and even tearing of the shoes. As a result, the shoes become unattractive and undesirable to wear even though they otherwise would have many hours of use left in them. A further problem with drying shoes in a clothes dryer is that the combination of the tumbling action and the heat tends to delaminate the shoe components that are bonded together. Delamination of the insoles is particularly troublesome.

Fabric bags are available for holding the shoes while drying them in a clothes dryer. The bags and shoes tumble together during the drying operation, so the bags do little to solve the scuffing or delamination problems associated with the tumbling action. Baskets can also be used to contain shoes in a dryer. A basket is held stationary to the dryer drum. However, the shoes are loose within the basket, so they still tumble during drying.

Thus, a need exists for improvements in the way athletic shoes are dried.

SUMMARY OF THE INVENTION

In accordance with the present invention, a shoe bar is provided that greatly improves the process of drying wet shoes. This is accomplished by fabricating the bar to hold one or more shoes stationary against the drum of a clothes dryer.

The shoe bar is normally in a relaxed configuration. The shoe bar has a relaxed length that is equal to or slightly greater than the inner diameter of the dryer drum. Although a rectangular cross-section for the bar is preferred, it may have an ovular or other cross-sectional shape. The width of the bar at its ends is less than the width of the inside of a shoe to be dried. A preferred material for the bar is a polycarbonate plastic.

According to one aspect of the invention, the shoe bar lies in a single plane. It has a constant rectangular cross-section between the ends. The ends are well rounded.

To use the shoe bar of the invention, an end of the bar is inserted into a shoe. Normally, the bar is used with two shoes, one at each end. The bar ends are pushed against the inside toe sections of the shoes. A person manually applies torques to the bar to bend it into a bowed configuration. The bent bar and the shoes are placed inside the clothes dryer. The toe of one shoe is placed in facing contact with the inner diameter of the dryer drum. The toe of the second shoe is placed close to the drum diametrically opposite the first shoe. The person removes the torques from the bar. The restoring force of the bar material causes it to tend to return from the bowed configuration to the relaxed configuration. However, the combination of the bar length and the thickness of the toe sections of the shoes prevents the bar from returning completely to the relaxed configuration. Accordingly, the bar remains slightly bent in a working configuration. The result is that the bar material continues to exert a restoring force that tends to return the bar to the relaxed configuration. The bar restoring force at the working configuration is sufficient to hold the shoes in place against the drum when the clothes dryer is turned on. The shoes thus do not tumble and scuff during drying.

When the shoes have dried, the shoe bar is again manually bent to the bowed configuration to release the force of the shoes against the drum. The bar and shoes are then removed from the dryer, and the bar is released to enable it to return to its relaxed configuration. An important benefit of the invention is that the dried shoes are not wrinkled.

In a modified embodiment of the invention, the shoe bar is fabricated with five sections: a middle section, two end sections, and two intermediate sections between the end and middle sections. The middle section is offset from the end sections. The amount of offset between the middle and end sections is about the same distance as the distance from the insole of a shoe to the top of the heel area of the shoe upper.

The end sections may but need not be coplanar. The end sections may be but are not necessarily parallel to either each other or to the middle section. The length of the end sections is less than the length of the inside of a typical athletic shoe. If desired, the width of the end sections can be greater than the width of the middle and intermediate sections. However, the width of the end sections is less than the width of the inside of the shoe to be dried.

A further modified embodiment of the invention is capable of drying four shoes at a time. For that purpose, the ends of the shoe bar are in the form of two plates separated by a space. A shoe can be placed on each plate. The double plate design can be used with either the single-plane embodiment, or with the embodiment in which a middle section is offset from end sections.

The method and apparatus of the invention, using the restoring force of an elastic material, thus dries athletic shoes in a clothes dryer without tumbling them. The probability that the shoes will be damaged is very low, even though the clothes dryer functions in the normal manner.

Other advantages, benefits, and features of the present invention will become apparent to those skilled in the art upon reading the detailed description of the invention.

BRIEF DESCRIPTION OF THE DRAWINGS

FIG. 1 is a front view of a first preferred embodiment of the present invention in a relaxed configuration.

FIG. 2 is a top view of FIG. 1.

FIG. 3 is front view of the invention with torques applied to it to place it in a bowed configuration.

FIG. 5 is a front view of a modified embodiment of the invention showing it in the relaxed configuration.

FIG. 6 is top view of FIG. 5.

DETAILED DESCRIPTION OF THE INVENTION

Figure 4:
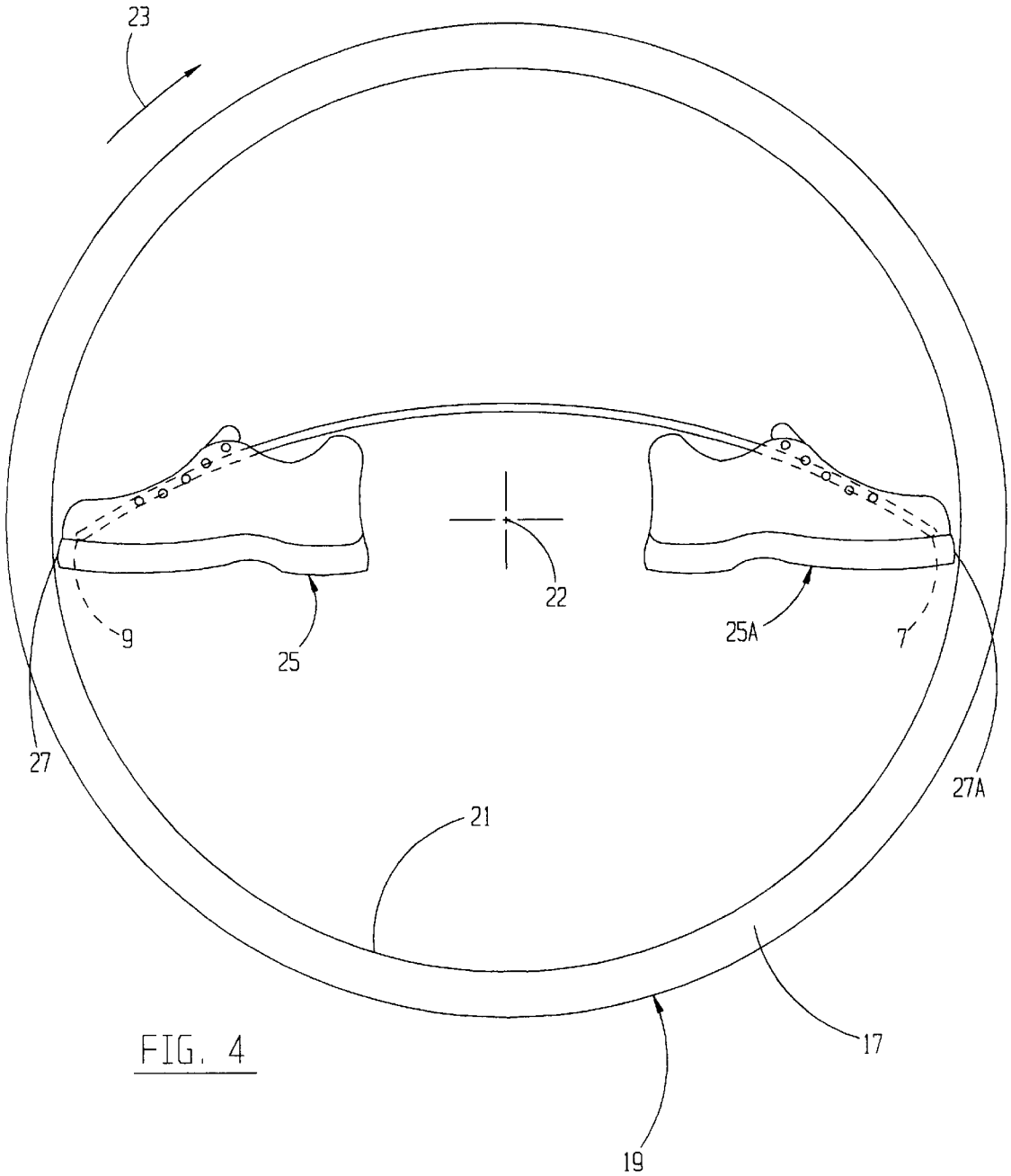
FIG. 4 is a view showing the invention in use.

Although the disclosure hereof is detailed and exact to enable those skilled in the art to practice the invention, the physical embodiments herein disclosed merely exemplify the invention, which may be embodied in other specific structure.

The scope of the invention is defined in the claims appended hereto.

Referring to FIGS. 1 and 2, a shoe bar 1 is illustrated that includes the present invention. As shown, the shoe bar 1 has a generally rectangular cross-section. However, it will be understood that other cross-sections such as circular, ovular, or square can also be used. In its simplest form, the bar is fabricated with a top surface 3 and a parallel bottom surface 5, opposed ends 7 and 9, and opposed edges 11 and 13. As illustrated, the bar is much longer than it is wide or thick. Satisfactory lengths for the bar range from between approximately 26.50 and 27.25 inches, with 27 inches being preferred. The corners 6 between the ends 7 and 9 and the surfaces 3 and 5 are well rounded, as are the corners 15 between the ends 7, 9 and the edges 11, 13. A minimum radius of approximately 0.50 inches for the corners 15 is satisfactory.

A preferred material for the shoe bar 1 is polycarbonate plastic, such as that manufactured by the General Electric Company under the trademark Lexan. For a bar made of polycarbonate material, a preferred width is between approximately 2.25 inches and 2.75 inches. A satisfactory thickness is between approximately 0.20 inches and 0.30 inches.

The shoe bar 1 is normally in the relaxed configuration of FIGS. 1 and 2. Manual application of equal and opposite torques T to the bar about respective axes parallel to and near the ends 7, 9 causes the bar to bend, FIG. 3. Upon releasing the torques T, the inherent restoring force of the bar material causes it to return to the relaxed configuration of FIG. 1.

The shoe bar 1 is particularly useful for drying shoes in a conventional clothes dryer. Looking at FIG. 4, reference numeral 17 represents the drum of a clothes dryer 19. The drum 17 has an inner diameter 21. The great majority of clothes dryers commercially available for home use have drums with an inner diameter 21 of approximately 26.50 inches. Thus, the bar has a length that is approximately 100 percent to 105 percent of the drum inner diameter. In operation, the drum rotates about an axis 22 in the direction of arrow 23 while heat is applied to the drum.

To use the shoe bar 1, its two ends 7 and 9 are inserted into the interiors of respective wet athletic shoes 25, 25A until the bar ends contact the interiors of the shoes at their toe sections 27, 27A. It is usually most convenient to insert the bar ends into the shoe toe sections 27, 27A outside of the clothes dryer 19. The bar is then manually bent by applying equal and opposite torques T into a bowed configuration similar to the configuration shown in FIG. 3. The shoes and bar are placed together inside the drum 17. The toe 27 of the shoe 25 is placed against the drum inner diameter 21 at any convenient place. Then the toe 27A of the other shoe 25A is placed close to the drum inner diameter diametrically opposite the toe of the first shoe. The torques T on the bar are released. The restoring force inherent in the bar material tends to straighten the bar to the relaxed configuration of FIG. 1. However, the combination of the thickness of the shoe at the toe sections and the size of the drum prevents the bar from fully achieving its relaxed configuration. Consequently, the bar remains in a working configuration, FIG. 4, with the bar material continuing to exert the restoring force. The result is that the bar continues to urge the shoe toes against the drum inner diameter and holds them there by friction.

With the shoe bar 1 and shoes 25, 25A in place, the clothes dryer 19 can be operated. The drum 17 rotates, and hot air is supplied to the drum interior in the usual way. The shoes remain firmly in place, stationary relative to the drum. Consequently, they do not tumble arid scuff against the drum. I have observed that moisture from the insides of the shoes beads up on the bar and migrates toward the center of the bar, where it quickly evaporates. The steady turning of the shoes relative to the dryer air flow also helps to efficiently dry the shoe interiors. A further benefit of the shoe bar of the invention is that the dried shoes do not wrinkle. If desired, other clothes can be placed in the dryer with the bar and shoes. The other clothes do not become entangled with the bar. In fact, I have placed denim pants and a denim jacket in the dryer with the bar and shoes without detrimental effect of the drying of any of the items.

It will be appreciated, of course, that the shoe bar 1 can be used to dry only one shoe. In that case, an end 7 or 9 of the bar without a shoe is placed directly against the drum inner diameter 21.

Further in accordance with the present invention, more than two shoes can be dried at one time. FIGS. 5 and 6 show a modified shoe bar 29 having an overall length and a thickness that are substantially similar to the length and thickness of the shoe bar 1 described previously. At the opposite ends 31 of the bar are a pair of spaced apart flat plates 35. The plates 35 are approximately four inches long and of the same width as the bar middle section 33. Each plate is inserted into a different shoe.

Figure 8:
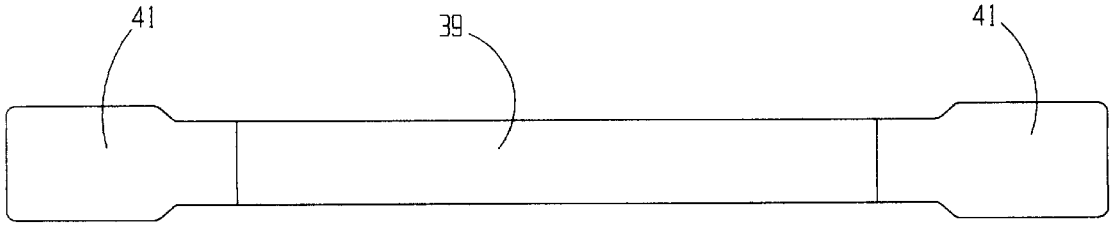
FIG. 8 is a top view of FIG. 7.
Figure 7:
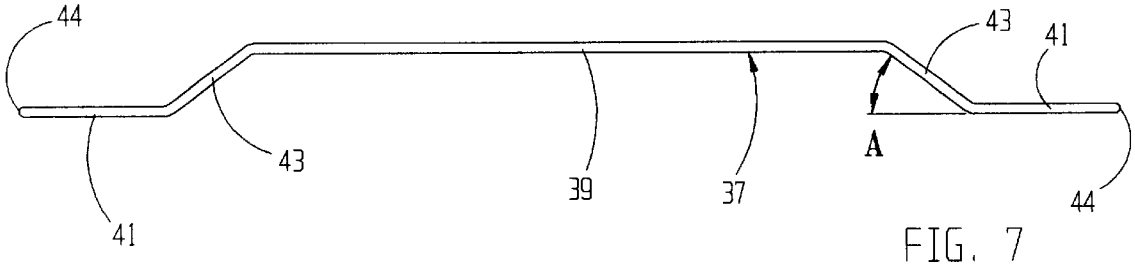
FIG. 7 is a front view showing a further modified embodiment of the invention in the relaxed configuration.

In a further modified embodiment of the invention, the shoe bar is made with offset sections. Turning to FIGS. 7 and 8, a shoe bar 37 has a middle section 39, two end sections 41, and two intermediate sections 43. The sections 39 and 41 are parallel but offset from each other. The intermediate sections 43 make an angle A with the end sections. I prefer that the angle A be approximately 45 degrees. However, other angles up to 90 degrees are also satisfactory. An offset between the end and middle sections of between approximately one and 1.50 inches works very well, with the preferred offset being approximately 1.25 inches. The distance between the shoe bar ends 44 is between approximately 26.50 inches and 27.25 inches, with 27 inches being preferred. As illustrated, the end sections 41 are lightly wider than the interior and middle sections.

Figure 9:
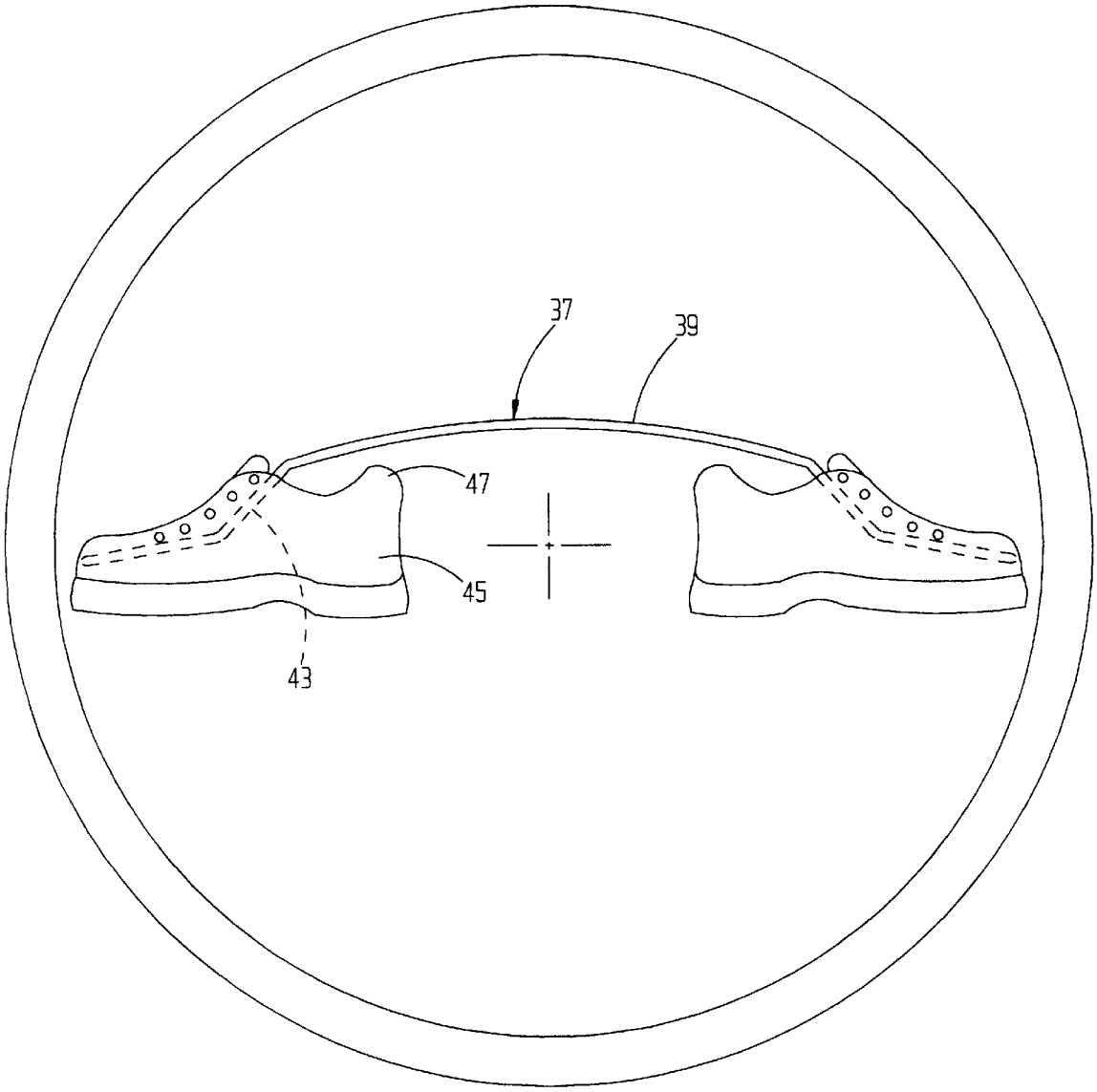
FIG. 9 is a view showing the shoe bar of FIGS. 7 and 8 in use.

The shoe bar 37 is shown in use in FIG. 9. The angled intermediate sections 43 are especially desirable because they enable the middle section 39 to avoid contact with the shoe uppers 45 at the heel end 47.

Figure 10:
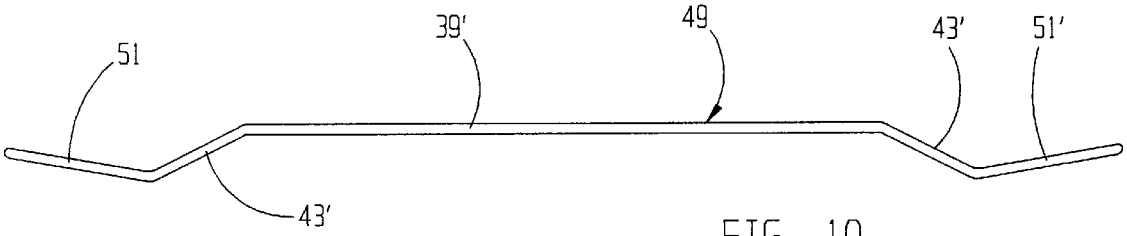
FIG. 10 is a front view of an alternate construction for the shoe bar in the relaxed configuration.

FIG. 10 shows an alternate construction for the shoe bar. The shoe bar 49 has a middle section 39' and intermediate sections 43' that are generally similar to the intermediate section 39 and intermediate sections 43 of the shoe bar 37 of FIGS. 7 and 8. The shoe bar 49 has end sections 51 that are offset from the middle section 39'. However, the end sections 51 are not parallel to the middle section 39' or to each other. The use of the shoe bar 49 is substantially similar to that of the shoe bar 39, FIG. 9. It will be understood that the two-plate design of FIGS. 5 and 6 can be used with the offset design of FIGS. 7, 8, and 10. That is, the single rectangular end sections 41 of the shoe bar 37, and the single end sections 51 of the shoe bar 49 can be replaced by the double plates 35 of the shoe bar 29.

In summary, the results and advantages of expensive athletic shoes can now be more fully realized. The shoe bar for drying shoes provides both convenience of use and longer life to athletic shoes. This desirable result comes from combining the elasticity of the bar with its carefully designed length. The bar ends are inserted into respective shoes. The bar is bent and placed in a clothes dryer. The toes of the shoes are placed diametrically across from each other and in contact with the dryer drum. The restoring force of the bar material presses the shoe toes firmly but gently against the drum, where they are held in place by friction. Operating the clothes dryer to rotate the drum does not dislodge the shoes. They therefore dry without tumbling and scuffing. The shoe bar is capable of drying four or more shoes at a time, if desired.

It will also be recognized that in addition to the superior performance of the shoe bar, its construction is such as to be of very modest cost in relation to the benefits it provides. Also, because there are no moving parts, the shoe bar will give indefinite service life without any maintenance.

Thus, it is apparent that there has been provided, in accordance with the invention, a shoe bar for drying shoes that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A shoe bar for holding at least one shoe in a clothes dryer having a rotatable drum that defines an inner diameter, the bar being made of a predetermined elastic material and having opposed first and second ends spaced apart a predetermined distance equal to between approximately 100 percent and 105 percent of the drum inner diameter when the bar is in a relaxed configuration, the bar having a width at the ends thereof less than the width of the interior of a selected shoe, the bar first end being insertable into the shoe, the bar being manually bendable to a bowed configuration and placable with a shoe into the drum with the toe of the shoe in contact with the drum inner diameter and the bar second end being placable proximate the drum inner diameter diametrically opposite the shoe, the bar then being releasable to enable the elastic material to exert a restoring force that tends to return the bar to the relaxed configuration, the bar remaining in a working configuration at which it presses the shoe against the drum inner diameter.

2. The shoe bar of claim 1 wherein the bar has a rectangular cross-section.

3. The shoe bar of claim 1 wherein the bar is made of a polycarbonate plastic material.

4. The shoe bar of claim 3 wherein the bar has a width of between approximately 2.25 inches and 2.75 inches and a thickness of approximately 0.25 inches.

5. The shoe bar of claim 1 wherein the bar lies in a single plane when it is in the relaxed configuration.

6. The shoe bar of claim 1 wherein at least one of the first and second ends is formed with two plates with a space therebetween, a selected one of the plates being insertable into said at least one shoe.

7. The shoe bar of claim 3 wherein:

a. the bar is made with a middle section, two end sections, and two intermediate sections between and joining the middle sections and respective end sections; and b. the middle section is parallel to and offset from the end sections.

8. The shoe bar of claim 7 wherein the middle section is offset from the end sections by approximately 1.25 inches.

9. The shoe bar of claim 8 wherein the intermediate sections make respective angles of approximately 45 degrees with the middle and end sections.

10. The shoe bar of claim 7 wherein:

a. the end sections are approximately three inches wide;

b. the interior sections and the middle section are each approximately 2.50 inches wide; and c. the middle, end, and interior sections are each approximately 0.25 inches thick.

11. The shoe bar of claim 7 wherein at least one of the bar end sections is comprised of two plates with a space therebetween, the plates being insertable into two different shoes.

12. The shoe bar of claim 7 wherein each of the bar end sections is approximately four inches long.

13. A combination of a pair of shoes having respective toe sections and heel sections; and a clothes dryer having a rotatable drum with a predetermined inner diameter, a shoe bar for drying shoes wherein the shoe bar comprises a selected elastic material that enables the bar to be manually bent in response to external torques being applied to the bar and to exert a restoring force that returns the bar to the relaxed configuration ir response to release of the external torques, the bar having opposed ends inserted into the toe sections of the pair of shoes with the toe sections of the shoes being in contact with the drum inner diameter and the bar being in a working configuration whereat the bar material exerts a restoring force that presses and retains by friction the shoe toe sections against the drum inner diameter, so that the clothes dryer can be operated to rotate the drum and dry the shoes without the shoes tumbling inside the drum.

14. The combination of claim 13 wherein the distance between the bar ends is approximately 100 percent to 105 percent of the drum inner diameter.

15. The combination of claim 13 wherein the bar has a generally rectangular cross-section.

16. The combination of claim 14 wherein:

a. the bar is made from a polycarbonate plastic material; and b. the bar has a width of approximately 2.25 inches, and a thickness of approximately 0.25 inches.

17. The combination of claim 13 wherein each of the bar ends is made with at least two plates separated by a space, each of the plates being inserted into a different shoe to thereby enable the bar to dry at least four shoes simultaneously.

18. The combination of claim 14 wherein the bar comprises a pair of end sections, a middle section offset from the end sections, and an intermediate section between the middle section and each of the end sections.

19. The combination of claim 18 wherein the end sections and the middle section are parallel.

20. The combination of claim 19 wherein the end section is offset approximately 1.25 inches from the middle section.

21. The combination of claim 18 wherein:

a. the middle and intermediate sections have respective widths of approximately 2.5 inches;

b. the middle, intermediate, and end sections have respective thicknesses of approximately 0.25 inches; and c. the end sections have respective widths of approximately three inches.

22. The combination cf claim 18 wherein the end sections are each formed with at least two plates separated by a space, the plates being insertable into each of the pair of shoes, so that the shoe bar dries four shoes simultaneously.

23. A method of drying a shoe having an upper that defines a toe section and a heel section comprising the steps of:

a. providing a clothes dryer having a rotatable drum with a predetermined inner diameter;

b. providing a bar made from a selected elastic material and having first and second ends that are spaced apart a distance between approximately 100 percent and 105 percent of the drum inner diameter when the bar is in a relaxed configuration;

c. inserting the bar first end into a shoe;

d. applying first torques to the bar and thereby bending the bar into a bowed configuration;

e. placing the bent bar and shoe into the dryer drum;

f. placing the shoe toe section against the dryer drum inner diameter;

g. placing the bar second end proximate the drum inner diameter generally diametrically opposite the bar first end;

h. removing the external torques from the bar;

i. relaxing the bar to a working configuration whereat the bar exerts a restoring force on the shoe against the drum inner diameter; and j. operating the clothes dryer to rotate the drum, so that the shoe does not tumble when the drum rotates.

24. A method of simultaneously drying multiple shoes having respective toe sections and heel sections comprising the steps of:

a. providing a clothes dryer having a rotatable drum with a predetermined inner diameter;

b. providing a shoe bar made from a selected elastic material and having first and second ends that are spaced apart a distance between approximately 100 percent and 105 percent of the drum inner diameter when the shoe bar is in a relaxed configuration, the shoe bar having a pair of plates on each of the first and second ends thereof;

c. inserting the pair of plates at each end of the shoe bar into respective different shoes;

d. applying first torques to the shoe bar and thereby bending the shoe bar into a bowed configuration;

e. placing the bent shoe bar and shoes into the dryer drum;

f. placing the toe sections of the shoes against the dryer drum inner diameter;

g. placing the shoe bar second end proximate the drum inner diameter generally diametrically opposite the shoe bar first end;

h. removing the external torques from the shoe bar;

i. relaxing the shoe bar to a working configuration whereat the shoe bar exerts a restoring force on the shoes against the drum inner diameter; and j. operating the clothes dryer to rotate the drum, so that the shoes do not tumble when the drum rotates, and thereby enabling four shoes to he dried at one time.

25. The method of claim 23 wherein:

a. the step of providing the shoe bar comprises the steps of offsetting a middle section of the shoe bar from two end sections, and joining each end section with the middle section by a respective intermediate section; and b. the step of inserting at least the shoe bar first end into a shoe comprises the step of avoiding contact of the shoe bar with the heel section of the shoe upper.

* * * * *